US005819844A

United States Patent [19]

King

[11] Patent Number: 5,819,844

[45] Date of Patent: Oct. 13, 1998

[54] BEAVER-TAIL TUBE ASSEMBLY AND TUBE CHANGING METHOD

[75] Inventor: Patrick D. King, Rantoul, Ill.

[73] Assignee: Vesuvius Crucible Company, Wilmington, Del.

[21] Appl. No.: 688,785

[22] Filed: Jul. 31, 1996

[51] Int. Cl.[6] ..... B22D 11/10; B22D 41/56

[52] U.S. Cl. ..... 164/488; 164/437; 222/606

[58] Field of Search ..... 164/488, 437; 222/594, 606, 607; 266/236

[56] References Cited

U.S. PATENT DOCUMENTS 5,188,743 2/1993 King ..... 222/590

FOREIGN PATENT DOCUMENTS 9503906 2/1995 WIPO .

*Primary Examiner*—Kuang Y. Lin
*Attorney, Agent, or Firm*—Sixbey Friedman Leedom & Ferguson; Thomas W. Cole

[57] ABSTRACT

An improved beaver-tail tube assembly is provided that is easily exchanged in place over a thin-slab casting mold by means of a conventional tube changer. The tube assembly includes a rectangular plate, and a tube body having a circular upper end that is mounted to an orifice in the plate for receiving molten metal, and a lower end that is elongated along its width for discharging molten metal into the elongated opening of a thin-slab casting mold. In the tube assembly of the invention, the upper end of the tube body is mounted to the opening in the plate so that the longitudinal axis of the elongated bottom end of the tube body is oriented at an angle of between about 25° and 55° with respect to a line orthogonal to the parallel sides of the plate. Such an angular mounting allows two or more tube assemblies of the invention to be arranged in a row which allows the plates of adjacent tube assemblies to engage one another, but does not allow contact between the elongated discharge ends of the tube bodies of the assemblies. This feature in turn allows a conventional tube changer to exchange one of the improved beaver-tail tube assemblies of the invention with another over a thin-slab casting mold without the need for spacers or modifications to the tube changer.

19 Claims, 2 Drawing Sheets

BEAVER-TAIL TUBE ASSEMBLY AND TUBE CHANGING METHOD

BACKGROUND OF THE INVENTION

This invention generally relates to pouring shrouds or tubes used to direct a flow of molten metal, such as steel, into a continuous casting mold and is specifically concerned with an improved beaver-tail tube assembly that is compatible for use with a conventional lift-type tube changer.

The use of pouring tubes to direct the flow of molten metal into a mold is well known in the art of casting steel. Such tubes generally comprise a refractory tube body having a lower open end, and an upper open end which is mounted in an annular opening of a refractory plate. In use, the plate is secured beneath the nozzle of a tundish containing molten steel with the discharge end of the nozzle in alignment with the annular opening in the plate where the top end of the tube body is secured. The bottom end of the tube is aligned with the inlet end of a continuous casting mold. Such tubes simultaneously direct a flow of molten steel into the continuous casting mold while shielding the flow of steel from ambient oxygen. The shielding function is particularly important in the continuous casting process, where the exposure of the molten steel to ambient oxygen can promote the formation of oxides which can compromise the quality of the resulting casting.

Over time, the refractory compounds forming such pouring tubes become eroded by the constant exposure to molten steel. Hence these tubes must be periodically replaced. To minimize the amount of interruption that such a tube replacement operation inflicts on a continuous casting operation, automatic tube changing devices have been developed. In such devices, a row of two or more pouring tubes are suspended by the plates surrounding their upper open ends via a pair of parallel rails such that the tubes are slidably movable along the rails. One of the pouring tubes is aligned in a working position between the nozzle of a tundish and the inlet of a continuous casting mold, while an unused pouring tube is positioned beside the working tube with one side of its plate directly abutting against one side of the plate of the working tube. When the working tube wears out, a hydraulically operated plunger pushes against one side of the plate of the replacement tube, thus slidably replacing the worn tube with the unused one.

While such devices are capable of effectively changing pouring tubes having tube bodies that are cylindrically shaped, they are incapable of changing "beaver-tail" type pouring tube assemblies of the type used to direct a flow of molten steel into a thin-slab casting mold. The reasons for this incapability are best understood with respect to FIGS. 1A and 1B. These Figures illustrate first and second beaver-tail tube assemblies 1*a,b,* each of which includes a plate 3 having a circular orifice 5 onto which the upper end 8 of a tube body 7 is mounted. The plate 3 of each of the tube assemblies 1*a,b* includes a pair of opposing sides 4*a,b.* As is best seen in FIG. 1A, tube assembly 1*a* is positioned with its inlet opening 9 in registry with the discharge opening 10 of a nozzle 11. Nozzle 11 is in turn mounted in the floor plate 12 of a tundish 13. The tundish 13 contains molten steel 14 which flows through the nozzle 11, through the inlet opening 9 of the tube body, and from thence to the elongated lower end 15 of the tube body 7. The elongated lower end 15 of the tube body 7 is in turn aligned with an elongated inlet opening 17 of a thin plate casting mold 20.

A lift-type tube changer 22 is provided for exchanging the used tube assembly 1*a* with the unused tube assembly 1*b* at an appropriate time. The tube changer 22 includes a pair of rails (indicated in phantom) that suspend both of the tube assemblies 1*a,b* over the casting mold 20. A hydraulically operated plunger 26 is provided for pushing the unused tube assembly 1*b* along the rails 24 into the operating position that tube assembly 1*a* presently holds. However, because the width W1 of the plate 3 is less than the width W2 of the elongated lower end 15 of the tube body 7, the moving force generated by the plunger 26 cannot be transmitted from the plate 3 of the tube assembly 1*b* to the plate 3 of the tube assembly 1*a* via side edges 4*a,b* unless a spacer plate 28 is provided therebetween. This particular method of adapting a tube changer to accommodate beaver-tail type tube assemblies is disclosed and claimed in PCT published patent application No. WO 95/03906. Without the provision of the spacer plate 28, the plunger 26 would merely push the elongated lower end 15 of the tube assembly 1*b* into the elongated lower end 15 of the assembly 1*a*, which in turn would result in the application of damaging moment forces between the tube body 7 of each of these assemblies 1*a,b* and their respective plates 3.

While the arrangement illustrated in the aforementioned published patent application would appear to provide an effective solution to the aforementioned problem, it is accompanied by three significant shortcomings. First, the use of spacer plates 28 necessitates the manufacture and installation of an additional component in the tube changer 22, with all its attendant expenses. Worse yet, such a spacer plate can accidently fall out of the rails 24 of the tube changer 22 and into the inlet 17 of the casting mold 20, where it could ruin a run of steel worth $20,000.00. Finally, the use of a spacer plate 28 necessarily lengthens the stroke that the plunger 2*b* must make in order to exchange one tube assembly for another, which may necessitate expensive modifications to this device.

Clearly, there is a need for an alternate technique for allowing a conventional tube changer to accommodate and exchange beaver-tail tube assemblies which does not rely upon the use of spacer plates with all their attendant disadvantages. Ideally, such a technique would not necessitate the manufacture of any additional components for use in either the tube changer or the tube assemblies themselves, nor any modifications to the tube changer.

SUMMARY OF THE INVENTION

Generally speaking, the invention is an improved beaver-tail tube assembly and tube changing method that overcomes the aforementioned shortcomings associated with the prior art without the need for spacer plates or modifications to the tube changer.

In the beaver-tail tube assembly of the invention, the circular upper end of the tube body is mounted to the plate so that the longitudinal axis of the elongated end of the tube body is oriented at an angle of between about 25° and 55° with respect to a line orthogonal to the parallel sides of its plate. In the preferred embodiment, the angle of inclination is between about 30° and 45°. Such an angle of inclination is sufficient to prevent contact between the elongated ends of the tube bodies of two adjacent tube assemblies when the plate of one tube assembly is engaged against the plate of another in a tube changer.

In the method of the invention, a first beaver-tail tube assembly of the invention is mounted on the rails of a tube changer in a working position between the outlet end of a molten metal discharge nozzle, and the inlet of a continuous casting mold, which may be a thin-slab casting mold. A second tube assembly of the invention is positioned adjacent to the first on the rails of the tube changer such that one of the parallel sides of the plate of the first tube assembly engages one of the parallel sides of the plate of the second tube assembly. When it becomes necessary to replace the first tube assembly due to wear, the plunger of the tube changer is used to push the second tube assembly such that it assumes the working position of the first tube assembly while simultaneously pushing the first tube assembly out of position. The fact that the elongated ends of the tube bodies of the first and second tube assemblies do not come into contact with one another due to the angled connection between the upper ends of the tube bodies and their respective plates allows a conventional tube changer to slidably manipulate a pair of such improved beaver-tail tube assemblies without the need for the placement of spacers between the plates of the assemblies.

BRIEF DESCRIPTION OF THE SEVERAL FIGURES

DETAILED DESCRIPTION OF THE PREFERRED EMBODIMENT

Figure 2A:
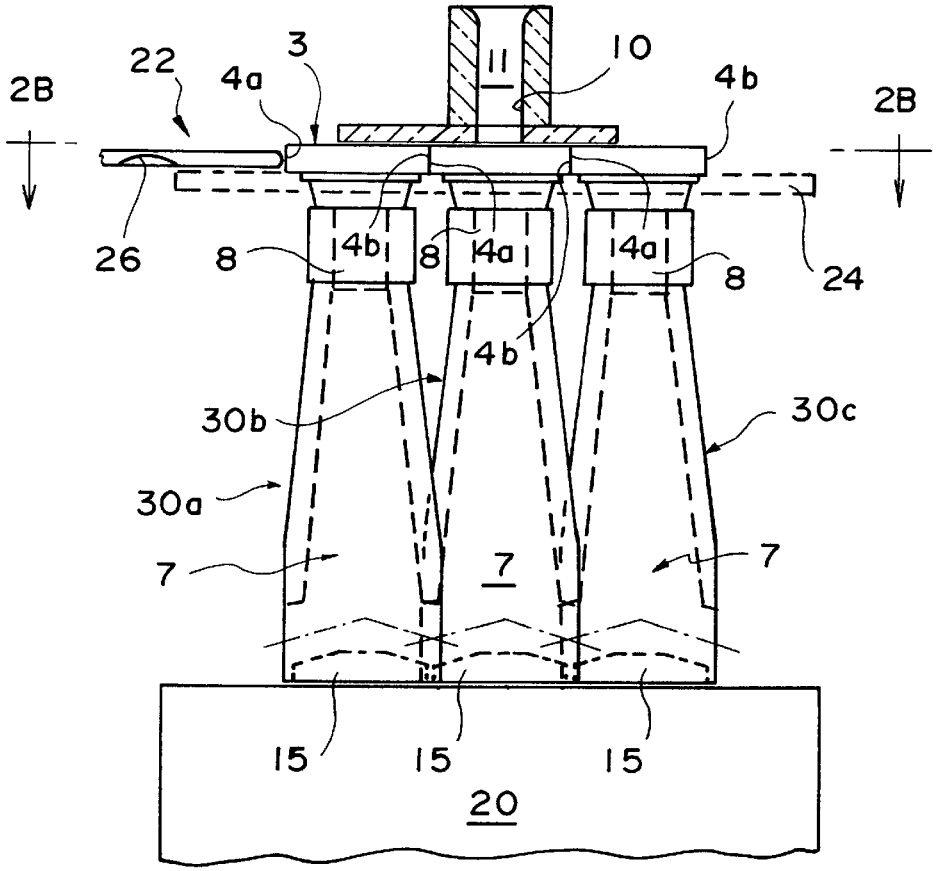
FIG. 2A is a partial cross-sectional side view of three improved beaver-tail tube assemblies of the invention, one of which is in a working position between the nozzle of a tundish and the inlet opening of a thin-slab casting mold.
Figure 2B:
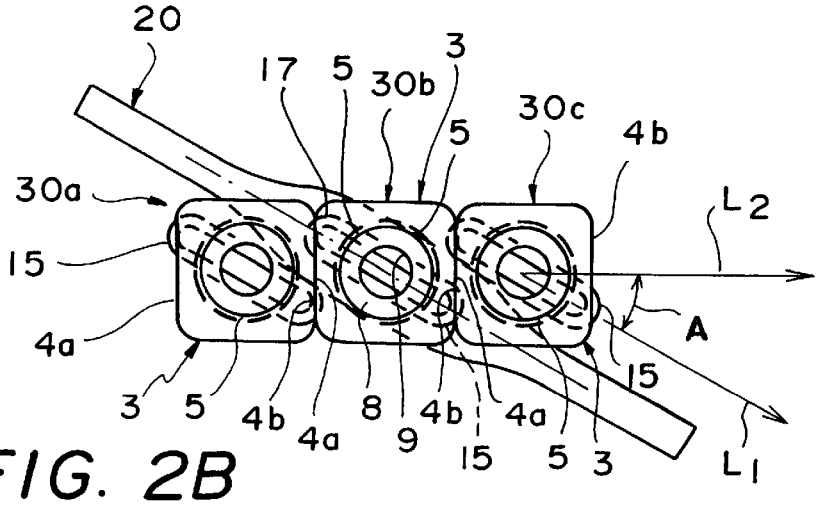
FIG. 2B is a plan view of the improved beaver-tail tube assemblies and casting mold of FIG. 2A along the line 2B—2B.

With reference now to FIGS. 2A and 2B, the improved beaver-tail tube assemblies 30*a,b* are in all respects identical to the previously described prior art tube assemblies 1*a,b*, with the critical exception that the upper portion 8 of the tube body 7 is joined to the circular orifice 5 of the plate 3 so that a longitudinal axis L1 of each of the elongated lower ends 15 is disposed at an angle A with respect to a line L2 orthogonal to the parallel sides 4*a,b* of each of the plates 3. In the preferred embodiment, angle A is between about 25° and 55°, and more preferably between about 30° and 45°. However, the most important aspect of angle A is that it be of a value that allows parallel sides 4*a,b* of the plates 3 of adjacent beaver-tail tube assemblies 30*a,b* to come into direct engagement with one another while at the same time preventing contact between the elongated lower ends 15 of the assemblies 30*a,b*. Since some beaver tail tube assemblies are manufactured by joining together separately molded and fired plates 3 and tube bodies 7, the manufacturing of one of the modified tube assemblies of the invention can be a very easy matter. However, even in instances where these components 3 and 7 have been integrally molded together in the prior art, it is not a particularly difficult matter to modify the molds of such assemblies so that they can produce tube assemblies of the invention. In either case, ease of manufacture constitutes an important advantage of the invention.

Figure 1A:
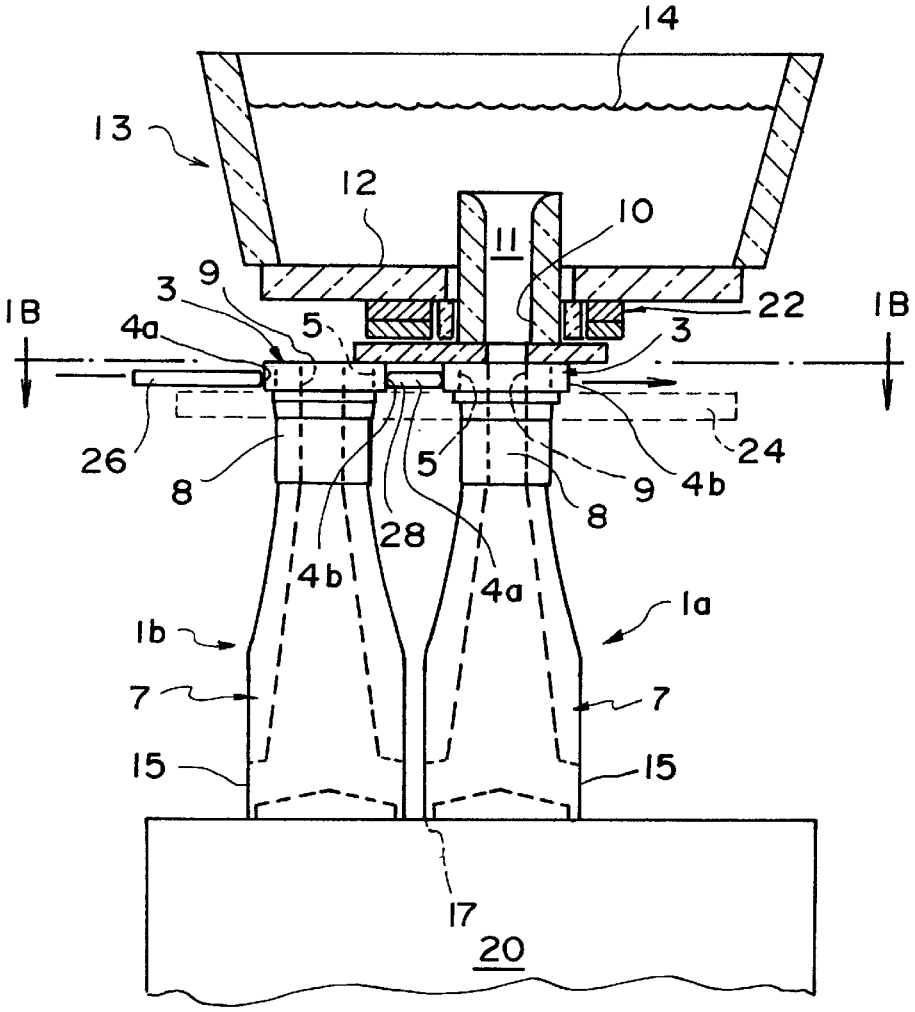
FIG. 1A PRIOR ART
FIG. 1A is a partial, cross-sectional side view of a working, prior art beaver-tail tube assembly disposed between the nozzle of a tundish and an inlet of a thin-slab casting mold, with a replacement tube assembly positioned beside it.
Figure 1B:
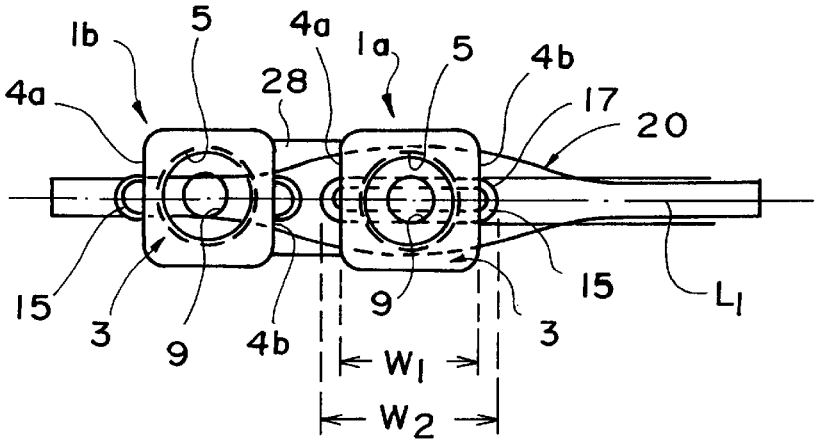
FIG. 1B PRIOR ART
FIG. 1B is a plan view of the prior art beaver-tail tube assemblies and casting mold of FIG. 1A along the line 1B—1B.

As can be appreciated in FIGS. 2A and 2B, such an angular orientation of the elongated lower ends 15 of the adjacent tube bodies 7 allows the plates 3 of each of the assemblies 30*a,b* to mutually engage one another on the rails 24 of a conventional tube changer 22 in exactly the same manner as the plates of tube assemblies with cylindrical tube bodies. Hence, the need for spacers 28 such as those discussed with respect to FIGS. 1A and 1B is obviated. The elimination of the need for such spacers 28 allows the tube changer 22 to accommodate the improved tube assemblies 30*a,b* without the need for the tube changer 22 to have a longer plunger stroke.

In the method of the invention, two or more improved beaver-tail tube assemblies 30*a,b* of the invention are provided by mounting the upper ends of the tube body 7 into the circular orifice 5 of their respective plates 3 so their elongated lower ends 15 are oriented at an angle A as illustrated in FIG. 2B. In the next step of the method, the improved tube assemblies 30*a,b* are loaded onto the rails 24 of a tube changer 22, with the first of the tube assemblies 30*a* disposed between the nozzle 11 and the inlet opening 17 of the thin-slab casting mold 20. The first of the tube assemblies 30*a* is used until erosion from the molten steel begins to compromise its integrity. At such a time, the plunger 26 of the tube changer 22 is actuated to apply a pushing force to the plate 3 of the tube assembly 30*b*. The application of such a pushing force slidably moves the tube assembly 30*a* to the right of the nozzle 11, where it is removed by the mill operators, while sliding the unused tube assembly 30*b* into a working position between the nozzle 11 and the inlet opening 17 of the thin-slab casting mold 20. Such an operation is made possible by the direct abutment of the parallel sides 4*a,b* of each of the plates 3 of the tube assemblies 30*a,b*. When the tube assembly 30*b* likewise becomes worn as a result of erosion by the constant flow of molten steel therein, another modified tube assembly (not shown) is loaded onto the rails 24 of the tube changer 22 to the left of the assembly 30*b* with its plate 3 in abutment with the plate of the assembly 30*b*. The tube changer 22 is again actuated so that the plunger 26 pushes the new tube assembly (not shown) into the position formerly held by the tube assembly 30*b*. While not specifically shown in the drawings, the tundish 13 is lifted to lift the tube assemblies 30*a,b* a short distance above the top of the casting mold 20 to obtain a necessary clearance between the bottom edges of the elongated ends 15 of the tube bodies 7 and the mold 20 during the tube changing action. Additionally, the normally continuous flow of molten steel out of the nozzle 11 is interrupted for a time period of about two seconds by the seating of a stopper rod (not shown) over the top of the nozzle 11 or the sliding of a gate valve (not shown) during the tube changing action.

Throughout the several Figures, the plates 3 of the several tube assemblies 30*a,b* have been illustrated as being square, with the length of all of the sides being equal. The plates 3 may also be rectangular. In such a case, the longer sides of the plates 3 will engage one another during the tube changing operation.

While both the improved tube assembly and method of the invention have been described with respect to a preferred embodiment, various additions, modifications, and variations will become evident to those persons of skill in the art. All such modifications, variations, and additions are intended to be encompassed within the scope of this patent, which is limited only by the claims appended hereto.

What is claimed is:

1. An improved beaver-tail tube assembly of the type including a plate having at least one pair of parallel sides, and a tube body having an upper end mounted to said plate for receiving molten metal, and a lower end elongated along its width a distance greater than the distance between said parallel sides of said plate, wherein the upper end of the tube body is mounted to said plate such that the longitudinal axis of said elongated end of said tube body is oriented at an angle of between about 25° and 55° with respect to a line orthogonal to said parallel sides of said plate.

2. The beaver-tail tube assembly defined in claim 1, wherein said angle is between about 30° and 45°.

3. The beaver-tail tube assembly defined in claim 1, wherein said plate is substantially square in shape.

4. The beaver-tail tube assembly defined in claim 1, wherein said plate is substantially rectangular in shape, and wherein said line is parallel with respect to the two shortest parallel sides.

5. An improved beaver-tail tube assembly of the type including a plate having at least one pair of parallel sides, and a tube body having an upper end mounted to said plate for receiving molten metal, and a lower end elongated along its width a distance greater than the distance between said parallel sides of said plate, wherein the upper end of the tube body is mounted to said plate such that the longitudinal axis of said elongated end of said tube body is oriented at an angle with respect to a line orthogonal to said parallel sides of said plate that is sufficient to prevent the elongated end of the tube body from contacting the elongated end of the tube body of a second improved beaver-tail tube assembly identical in structure to said first improved beaver-tail tube assembly and whose plate engages the plate of the first improved tube assembly.

6. The beaver-tail tube assembly defined in claim 5, wherein said angle is sufficient to prevent contact between said elongated ends when a parallel side of the plate of the second improved beaver-tail tube assembly engages a parallel side of the plate of the first improved beaver-tail tube assembly.

7. The beaver-tail tube assembly defined in claim 6, wherein said angle is between about 25° and 55°.

8. The beaver-tail tube assembly defined in claim 6, wherein said angle is between about 30° and 45°.

9. The beaver-tail tube assembly defined in claim 5, wherein said plates of both said first and second tube assemblies is substantially square.

10. The beaver-tail tube assembly defined in claim 6, wherein said plates of both said first and second tube assemblies are substantially rectangular, and wherein one of said longer sides of the plate of one tube assembly engages one of the longer sides of the plate of the other tube assembly.

11. A method of changing a first beaver-tail tube assembly positioned over a casting mold with a second beaver-tail tube assembly, wherein each assembly includes a plate, a tube body having an upper end mounted in said plate, and a lower end elongated along its width a distance greater than a width of the plate, comprising the steps of:

mounting the upper end of the tube body of each assembly in a position in its respective plate that allows the plates of said assemblies to engage while preventing contact between the elongated ends of their respective tube bodies, and pushing the plate of said second tube assembly against the plate of said first tube assembly to move said second tube assembly into a position over a casting mold for directing a flow of molten metal into said mold.

12. The method of changing a first beaver-tail tube assembly as defined in claim 11, wherein said casting mold is elongated, and said second beaver-tail tube assembly pushes said first assembly in a direction that is oblique with respect to the longitudinal axis of said mold.

13. The method of changing a first beaver-tail tube assembly as defined in claim 11, wherein the plates of each of said tube assemblies each include a pair of parallel sides spaced a distance apart that is less than the elongated width of its respective tube body.

14. The method of changing a first beaver-tail tube assembly as defined in claim 13, wherein a parallel side of the plate of the second tube assembly engages and pushes against a parallel side of the plate of the first tube assembly to move said second tube assembly into said position over said mold to direct a flow of molten metal therein.

15. The method of changing a first beaver-tail tube assembly as defined in claim 12, wherein said casting mold is a thin-slab mold having an elongated opening on one end that is registrable with the elongated end of the tube body of both said first and second tube assemblies.

16. The method of changing a first beaver-tail tube assembly as defined in claim 14, wherein the longitudinal axis of the elongated tube ends of both of said first and second tube assemblies are mounted at an angle of between about 25° and 55° with respect to a line orthogonal to said parallel sides of said tube plates.

17. The method of changing a first beaver-tail tube assembly as defined in claim 14, wherein the longitudinal axis of the elongated tube ends of both of said first and second tube assemblies are mounted at an angle of between about 30° and 45° with respect to a line orthogonal to said parallel sides of said tube plates.

18. The method of changing a first beaver-tail tube assembly as defined in claim 11, wherein a tube changing device pushes the plate of said second tube assembly against the plate of said first tube assembly.

19. The method of changing a first beaver-tail tube assembly as defined in claim 11, wherein the plates of the tube assemblies are rectangular, and wherein the longer side of the rectangular plate of the second tube assembly pushes against the longer side of the rectangular plate of the first tube assembly when said second tube assembly is moved into said position over a casting mold.

* * * * *